United States Patent [19]

Sundin

[11] 4,123,314

[45] Oct. 31, 1978

[54] APPARATUS AND METHOD FOR JOINING WEBS ON THE FLY

[75] Inventor: George H. Sundin, Hermantown, Minn.

[73] Assignee: Conwed Corporation, St. Paul, Minn.

[21] Appl. No.: 826,173

[22] Filed: Aug. 19, 1977

[51] Int. Cl.[2] ..... B31F 5/00; B65H 19/14

[52] U.S. Cl. ..... 156/505; 242/58.3

[58] Field of Search ..... 156/504, 505, 157, 159; 242/58.1, 58.3, 58.4

[56] References Cited

U.S. PATENT DOCUMENTS

| | | | |
|---|---|---|---|
| 3,227,594 | 1/1966 | Ryan | 156/159 |
| 3,717,057 | 2/1973 | Takimoto | 156/505 |
| 3,813,053 | 5/1974 | Butler et al. | 242/58.4 |
| 3,939,031 | 2/1976 | Takimoto | 156/505 |

*Primary Examiner*—Douglas J. Drummond
*Attorney, Agent, or Firm*—Eyre, Mann, Lucas & Just

[57] ABSTRACT

Strips of resilient material on each of two normally stationary spaced-apart rolls contact and press against opposite sides of a web being supplied to a using process and the leading edge of a reserve web. At least one strip of adhesive tape, lightly adhered to one of the strips of resilient material with its adhesive side facing out, bonds the leading edge of the reserve web to the supply web on the fly without stopping the motion of the web. When the web consists of netting material, adhesive tape is used on both rolls and the adhesive tape is pressed face to face by the resilient material through the openings in the netting to adhere to each other, thus pocketing the netting material between them.

7 Claims, 7 Drawing Figures

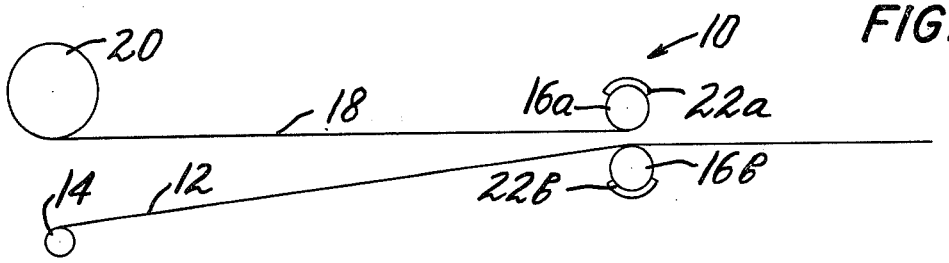
FIG. 1
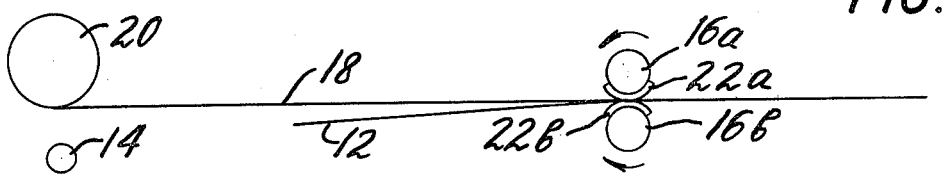
FIG. 3
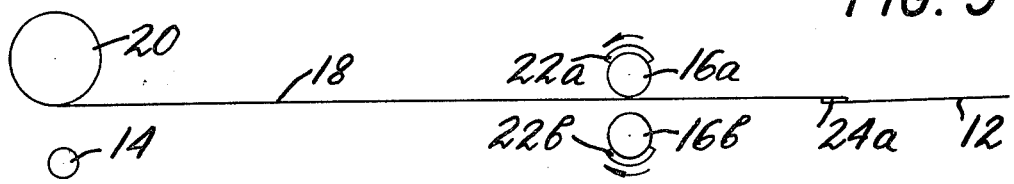
FIG. 5
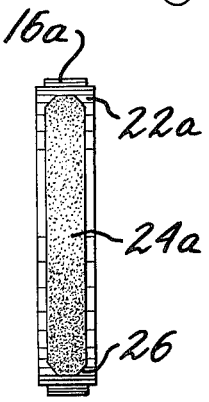
FIG. 2
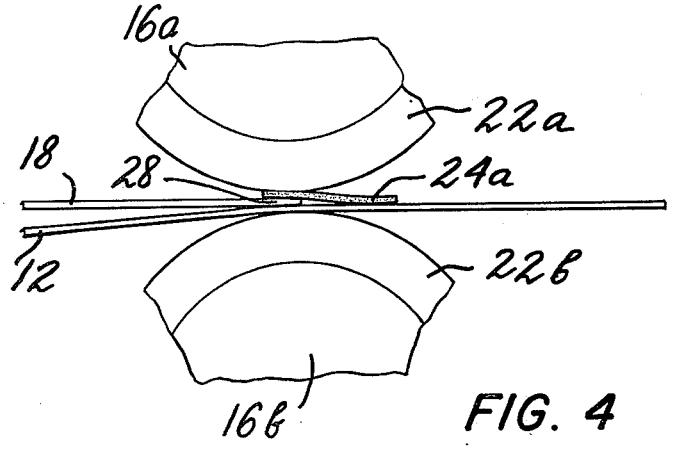
FIG. 4
FIG. 6
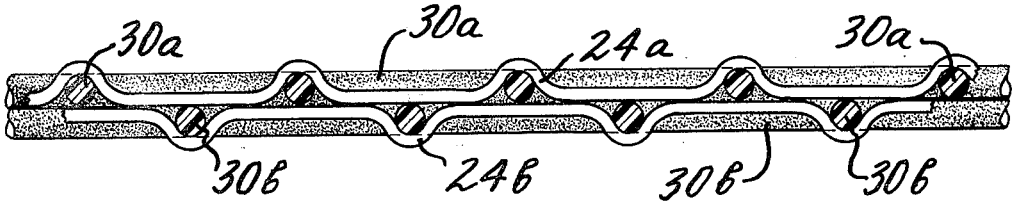
FIG. 7
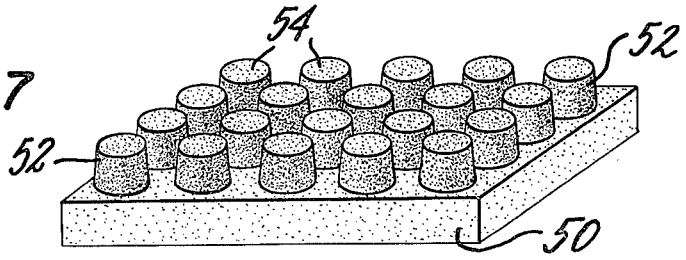

APPARATUS AND METHOD FOR JOINING WEBS ON THE FLY

BACKGROUND OF THE INVENTION

In operations which use a continuous supply of web material such as paper, cloth, or netting it has been customary to feed the using process from a first roll while having a second roll standing by to be used upon the first roll running out of material. Some means for splicing the leading edge of the web from the reserve roll to the supply web is necessary in order to enable continuous supply without interruption for splicing. In the prior art, this has been accomplished by providing a festoon from which a short-term supply of web can be drawn while the supply web and reserve web are stopped and attached together and the reserve roll accelerated to operating speed. This type of process is shown in U.S. Pat. Nos. 3,841,944 and 3,836,089. The present invention seeks to avoid the complications inherent in stopping the web supply.

SUMMARY OF THE INVENTION

A web of material, such as paper, cloth or netting passes from a supply roll to a using process between two stationary spaced-apart rolls. The leading edge of a web from a reserve roll rests between the spaced-apart rolls. Although not a part of the present invention, a festoon, of a type well known in the art, may be employed to aid in accelerating the reserve roll. Means may be provided for cutting off the trailing edge of the former supply web upon attachment and feeding of the reserve web. Alternatively, manual or automatic means can be used to sense the passage of the end of the supply web and the attachment process described can be performed just before it passes between the spaced-apart rolls. This method is desirable since it eliminates trailing edge scrap.

Each of the two spaced-apart rolls has a strip of resilient material covering from about 10 to about 90 and preferably about 30 to 60 percent of its perimeter and extending over the length of the roll. The spacing of the rolls and the thickness of the resilient material is such that, when the rolls are rotated, the two strips of resilient material meet face to face with the supply and reserve webs between them. The two strips of resilient material bear against each other and apply pressure upon each other and to the two webs. A strip splicing means such as adhesive tape or the like is lightly adhered to at least one of the strips of resilient material with its adhesive side facing out.

In the stationary spaced-apart condition of the rolls, no opposing pressure is placed on the supply web and the leading edge of the reserve web. Consequently, the supply web passes between them and the leading edge of the reserve web rests in position between them awaiting attachment. When it is desired to splice the leading edge of the reserve web to the supply web, the spaced-apart rolls are simultaneously rotated through a single revolution at a peripheral speed substantially equal to the linear speed of the supply web. The two strips of resilient material are rotated toward each other thus closing the space between the rollers. The strips of resilient material press against opposite sides of the supply web and the leading edge of the reserve web and thereby tend to accelerate the reserve web and begin feeding it in parallel with the supply web. The strip of adhesive tape on one of the strips of resilient material is rotated into contact with the two webs and overlaps the leading edge of the reserve web thus splicing it to the supply web. The lightly attached adhesive tape is readily stripped from the resilient material as the resilient material is rotated out of contact. The supply web may then be cut if desired since its function is assumed by the reserve web. Alternatively, the splice may be manually or automatically timed to occur just before the end of the supply roll passes between the spaced-apart rollers, thus eliminating tail-end scrap. Also, one or both of the facing surfaces of the webs may be treated with pressure-sensitive adhesive at their facing areas of contact instead of using adhesive tape. The resilient material may then adhere the two webs together by applying pressure to the pressure-sensitive adhesive.

When the web is a foraminous material, such as plastic netting, two strips of adhesive tape are used; in corresponding positions on each strip of resilient material. When the supply roll is about to run out, the spaced-apart rolls are rotated one turn at a peripheral speed equal to the speed of the web passing between them. As a result, the strips of adhesive tape on the two rolls come to bear against opposite sides of the sandwich of the web from the supply roll and the leading edge of the web from the reserve roll. The resilient material presses the adhesive tape through the openings in the foraminous material and causes abutting portions of the two strips of adhesive tape to bond tenaciously together. The foraminous material is thus not only bonded to the adhesive tape but is also pocketed between the bonded-together tape strips.

BRIEF DESCRIPTION OF THE DRAWINGS

FIG. 1 shows a schematic diagram of the present invention.

FIG. 2 shows a close-up view of one of the rolls having adhesive tape affixed thereto.

FIG. 3 shows the roll positions during the making of a splice.

FIG. 4 shows a close-up end view of a splice being made.

FIG. 5 shows the situation after completion of a splice.

FIG. 6 shows a splice in foraminous material.

FIG. 7 shows a rubber finger-type resilient material.

DETAILED DESCRIPTION OF THE PREFERRED EMBODIMENT

Referring to FIG. 1, the splicing apparatus of the present invention is shown generally at 10. Supply web 12 is unrolled from a supply roll 14 and passes between upper and lower spaced-apart rolls **16*a*, 16*b* respectively. The upper and lower spaced-apart rolls 16*a*, 16*b* are normally stationary. The leading edge of reserve web 18 rests stationarily between the upper and lower spaced-apart rolls adjacent to the supply web 12. The reserve web 18 is the leading edge of a reserve supply from reserve roll 20. The spacing between the upper and lower spaced-apart rolls 16*a*, 16*b* is great enough that no pressure is applied between supply web 12 and reserve web 18. The upper and lower spaced-apart splicing rolls 16*a*, 16*b* carry strips of resilient material 22*a*, 22*b* respectively covering from about 10 to about 80 percent of their circumference and extending substantially across the respective rolls. The resilient material can be rubber or plastic foam but the preferred embodiment is fingered rubber shown in FIG. 7 similar to products used for door mats. A base 50 is integrally molded with finger-like projections 52 projecting therefrom. The finger-like projections have flat tips 54 parallel to the base 50** forming a resilient bearing surface.

Referring momentarily to FIG. 2 which shows upper roll 16*a* with the strip of resilient material 22*a* affixed thereto, a strip of adhesive tape 24*a* is lightly bonded to the strip of resilient material 22*a* with its adhesive side facing out. The strip of adhesive tape 24*a* extends substantially across the entire working area of the strip of resilient material 22*a*. The adhesive tape 24*a* may be adhered in any convenient way such as with one or more small strips of tape (not shown) but the preferred method is to double back the corners 26 of the adhesive tape 24*a* so that small triangular tacky surface areas on the bent-over corner contact the strip of resilient material 22*a* and lightly secure it there.

When the supply roll 14 is about to run out of material, the upper and lower spaced-apart rolls are rotated for one turn at a peripheral speed equal to the web speed. The thickness of the strips of resilient material 22*a*, 22*b* is great enough to completely occupy the space previously existing between the spaced-apart rolls and furthermore it is great enough to apply opposing pressure to opposite sides of the supply web 12 and reserve web 18. The strip of adhesive tape 24*a* is firmly pressed over the end of the reserve web 18 and to the supply web 12 thus bonding them together. The resulting splice is shown in FIG. 4. The strip of adhesive tape 24*a* overlaps the leading edge 28 of the reserve web 18 and is bonded to the face of the supply web 12. Means (not shown) may be provided for trimming the supply web 12 immediately upon splicing. Such trimming means are well known in the art and do not form a part of the present invention therefore they are not shown. Alternatively, manual or automatic sensing can be used to determine when the supply web 12 is just about to run out and the single rotation of the spaced-apart rolls 16*a*, 16*b* can be triggered to create the splice just an instant before the tail end of the supply web 12 passes between them. FIG. 5 shows the condition just after the splice has been completed. The spaced-apart rolls 16*a*, 16*b* have completed their single revolution and have returned to their stationary positions in which the strips of resilient material 22*a*, 22*b* are held out of contact with the web. The former supply web 12 is spliced by a strip of tape 24*a* to the former reserve web 18 which now assumes the identity of a supply web. A new reserve roll may be placed in location 14 to enable continuation of the process upon the running out of material from roll 20.

When the supply web 12 and reserve web 18 are of foraminous material such as plastic net having substantial openings between the net strands, a variation of the procedure described in the preceding is used. A strip of adhesive tape 24*a* is lightly adhered as before to upper resilient strip 22*a* and a second strip of adhesive tape 24*b* lightly adhered in a corresponding location to lower strip of resilient material 22*b*. Upon actuation of the upper and lower spaced-apart rolls as previously described, the two strips of adhesive tape 24*a*, 24*b* are pressed against opposite sides of the foraminous webs. As shown in FIG. 6, the resilient nature of the resilient strips 22*a*, 22*b* press the strips of adhesive tape 24*a*, 24*b* between the strands of upper netting 30*a* and the lower netting 30*b* and forces the facing adhesive surfaces of the adhesive strips 24*a*, 24*b* to bond tenaciously together. Thus the strands of the netting 30*a*, 30*b* are not only adhered to the adhesive tape 24*a*, 24*b* but are also pocketed between the bonded-together strips of adhesive tape 24*a*, 24*b* to add additional strength to the splice. Because the bond can be created through the body of the two webs, there is no need for the splice to overlap the end of the reserve web.

It will be understood that the claims are intended to cover all changes and modifications of the preferred embodiments of the invention, herein chosen for the purpose of illustration which do not constitute departures from the spirit and scope of the invention.

What is claimed is:

1. Apparatus for splicing moving web comprising:

(a) first and second rolls;

(b) said first and second rolls being parallel and spaced apart;

(c) a first strip of resilient material on said first roll, said strip of resilient material covering from about 10 to about 80 percent of the circumference of said first roll and extending over substantially the entire length of said first roll;

(d) a second strip of resilient material on said second roll, said second strip of resilient material covering from about 10 to about 80 percent of the circumference of said second roll and extending over substantially the entire length of said second roll;

(e) means for feeding a supply web between said first and second rolls;

(f) means for positioning the leading edge of a reserve web between said rolls;

(g) said first and second rolls being normally stationary and being adapted when actuated to simultaneous rotation through a turn at a peripheral velocity substantially equal to the linear speed of the web; and (h) said first and second strips of resilient material being out of contact in the stationary position of the first and second rolls and applying opposing force to each other during rotation.

2. Apparatus recited in claim 1 wherein at least one of said first and second strips of resilient material being a sheet having rubber fingers projecting therefrom.

3. Apparatus recited in claim 1 further comprising pressure sensitive adhesive means for splicing said supply and reserve webs, said means for splicing being actuated by said opposing force.

4. Apparatus for splicing a reserve web to a moving supply web comprising:

(a) first and second parallel cylindrical spaced-apart splicing rolls having stationary axes;

(b) means for feeding a supply web between said first and second splicing rolls;

(c) means for positioning the end of a reserve web between said splicing rolls;

(d) said splicing rolls being normally stationary;

(e) resilient means covering between 10 and 80 percent of the circumference of at least one of said splicing rolls, the uncovered part of said at least one splicing roll facing the other splicing roll in the normally stationary position;

(f) pressure sensitive means for attaching the leading edge of said reserve web to said supply web;

(g) said splicing rolls being operative when actuated to perform one revolution at a peripheral velocity substantially equal to the velocity of the supply web; and (h) said resilient means being rotated into opposition with the other splicing roll whereby said reserve web, supply web and pressure sensitive means are pressed between said splicing rolls during said one revolution.

5. Apparatus for splicing the leading edge of a web of foraminous material to a moving supply web of foraminous material on the fly comprising:

(a) means for holding a supply roll adapted to supplying said supply web;
(b) means for holding a reserve roll adapted to supplying said reserve web;
(c) first and second parallel spaced-apart splicing rolls;
(d) said splicing rolls being adapted to the passage therebetween of said moving supply web;
(e) said splicing rolls being adapted to the positioning therebetween of the leading edge of said reserve web;
(f) a first axial strip of resilient material attached to and covering from about 10 to about 90 percent of the perimeter of said first splicing roll thereby leaving a first longitudinal area uncovered;
(g) a second axial strip of resilient material attached to and covering from about 10 to about 90 percent of the perimeter of said second splicing roll thereby leaving a second longitudinal area uncovered;
(h) said first and second splicing rolls being normally stationary with said first and second longitudinal areas facing each other;
(i) said first and second splicing rolls, when actuated, being operative to perform a single revolution at a peripheral velocity equal to the speed of said moving supply web; and
(j) said first and second strips of resilient material being operative during rotation of said splicing rolls to apply opposing force on opposite sides of said supply web and reserve web, and being further operative to press through the openings in said foraminous material to press directly one upon the other.

6. Apparatus for splicing the leading edge of a web of foraminous material on the fly comprising:

(a) means for holding a supply roll adapted to supplying said supply web;
(b) means for holding a reserve roll adapted to supplying said reserve web;
(c) first and second parallel spaced-apart splicing rolls;
(d) said splicing rolls being adapted to the passage therebetween of said moving supply web;
(e) said splicing rolls being adapted to the positioning therebetween of the leading edge of said reserve web;
(f) a first axial strip of resilient material attached to and covering from about 10 to about 90 percent of the perimeter of said first splicing roll thereby leaving a first longitudinal area uncovered;
(g) a second axial strip of resilient material attached to and covering from about 10 to about 90 percent of the perimeter of said second splicing roll thereby leaving a second longitudinal area uncovered;
(h) said first and second splicing rolls being normally stationary with said first and second longitudinal areas facing each other;
(i) said first and second splicing rolls, when actuated, being operative to perform a single revolution at a peripheral velocity equal to the speed of said moving supply web;
(j) said first and second strips of resilient material being operative during rotation of said splicing rolls to apply opposing force on opposite sides of said supply web and reserve web, and being further operative to press through the openings in said foraminous material to press directly one upon the other; and
(k) at least one of said first and second strips of resilient material being a sheet having rubber fingers projecting therefrom.

7. Apparatus for splicing first and second webs of foraminous material on the fly at least one of said webs being in motion;

(a) means for holding reels for feeding said first and second webs;
(b) first means for holding face-out adhesive tape non-touchingly adjacent said first web;
(c) second means for holding face-out adhesive tape non-touchingly adjacent said second web;
(d) rotating means for bringing said first and second strips of face-out adhesive tape aligned with each other against the opposed surfaces of overlapped webs of said foraminous material at a peripheral velocity substantially equal to the speed of the moving web; and
(e) resilient means on said rotating means for urging each strip of adhesive tape through the openings in said foraminous webs into face-to-face adhesive contact with the other strip of adhesive tape, whereby said first and second webs of foraminous material are captured together by said face-to-face adhesive contact.

* * * * *